US007993151B2

(12) United States Patent
Chuo et al.

(10) Patent No.: US 7,993,151 B2
(45) Date of Patent: Aug. 9, 2011

(54) SHIELDED INSERTION AND CONNECTION STRUCTURE OF FLAT CABLE CONNECTOR

(75) Inventors: Chih-Heng Chuo, Zhongli (TW); Gwun-Jin Lin, Taoyuan (TW); Kuo-Fu Su, Zhongli (TW)

(73) Assignee: Advanced Flexible Circuits Co., Ltd., Taoyuan County (TW)

( * ) Notice: Subject to any disclaimer, the term of this patent is extended or adjusted under 35 U.S.C. 154(b) by 125 days.

(21) Appl. No.: 12/588,279

(22) Filed: Oct. 9, 2009

(65) Prior Publication Data

US 2011/0014811 A1 Jan. 20, 2011

(30) Foreign Application Priority Data

Jul. 15, 2009 (TW) ..... 98123966 A

(51) Int. Cl.
*H01R 12/24* (2006.01)

(52) U.S. Cl. ..... 439/260; 439/607.32

(58) Field of Classification Search ..... 439/493, 439/495, 497, 260, 67, 77, 607.32
See application file for complete search history.

(56) References Cited

U.S. PATENT DOCUMENTS

| | | | | |
|---|---|---|---|---|
| 6,676,444 | B2 * | 1/2004 | Noro | 439/579 |
| 6,733,326 | B2 * | 5/2004 | Lee | 439/495 |
| 7,238,044 | B2 * | 7/2007 | Uchida et al. | 439/492 |
| 7,520,774 | B2 * | 4/2009 | Watanabe | 439/493 |
| 2007/0042627 | A1 * | 2/2007 | Hyun et al. | 439/260 |
| 2007/0123094 | A1 * | 5/2007 | Su et al. | 439/492 |

* cited by examiner

*Primary Examiner* — Neil Abrams
*Assistant Examiner* — Phuongchi T Nguyen
(74) *Attorney, Agent, or Firm* — Rosenberg, Klein & Lee

(57) ABSTRACT

A shielded insertion and connection structure for a flat cable connector includes a receiving housing and a hold-down member. The receiving housing forms a receiving compartment and two side walls formed at opposite ends of the receiving compartment. The hold-down member has opposite ends that respectively form pivot structures for pivotal coupling to the side walls and rotation between an open position and a holding position. The hold-down member is made of metal and the receiving housing is at least partly made of metal to form a conduction section, which is connected to a grounding terminal. When the hold-down member is at the open position and a circuit flat cable is inserted into the receiving compartment, the hold-down member is operated to depress and hold the circuit flat cable and the hold-down member is put in electrical connection with the grounding terminal through the conduction section.

8 Claims, 8 Drawing Sheets

SHIELDED INSERTION AND CONNECTION STRUCTURE OF FLAT CABLE CONNECTOR

FIELD OF THE INVENTION

The present invention relates to a structure of electrical connector, and in particular to a shielded insertion and connection structure of a flat cable connector.

BACKGROUND OF THE INVENTION

A connector is a device that realizes electrical connection between electrical wires, circuit boards, and electrical components, and thus provides a separable interface between subsystems of an electrical or electronic system for communication of signals and/or power therebetween. Thus, electrical connectors are widely used in various electrical/electronic devices, such as a notebook computer and a personal digital assistant (PDA).

A regular connector is often soldered to a circuit board with terminals thereof to put in electrical engagement with contacts of circuit layout on the circuit board to establish electrical connection therebetween. On the other hand, in some applications, a connector also serves to retain and fix another electrical component, such as fixing a flexible flat cable. Thus, an electrical connector may interface between a flexible flat cable and a printed circuit board to serve as means for connection and transfer of electrical signals.

A known electrical connector, which is often referred to as zero insertion force (ZIF) connector is structured to comprise a receiving housing and a hold-down member. The receiving housing forms a receiving space and two side walls at opposite ends of the receiving space. The receiving space holds a plurality of electrically conductive terminals. The hold-down member has opposite ends that respectively form pivot structures for pivotally connecting the hold-down member to the side walls of the receiving space, whereby when the hold-down member is operated, the hold-down may rotate with the pivots as a rotation center between an open position and a holding position.

SUMMARY OF THE INVENTION

However, in the known connector, the hold-down member is made of a non-metallic material. When signals and/or power is transmitted through the connector and a circuit flat cable connected thereto in an electrical/electronic system, the hold-down member, even being depressed down to hold the flat cable, cannot conduct external electromagnetic interference through a grounding terminal of the connector to a circuit board connected thereto. As a consequence, noises caused in the transmission of signals between systems that degrade the quality of signals cannot be effectively overcome.

Thus, an objective of the present invention is to provide a shielded insertion and connection structure of a flat cable connector, which effectively improves the deficiency of being easily interfered with by external electromagnetic interference at the time when a conventional circuit flat cable is inserted and connected to a connector and thus providing excellent shielding result.

The technical solution that the present invention adopts to overcome the above discussed problems is a shielded insertion and connection structure of a flat cable connector, comprising a receiving housing and a hold-down member. The receiving housing forms a receiving compartment and two side walls formed at opposite ends of the receiving compartment. A plurality of conductive terminals are received in the receiving compartment. The hold-down member has opposite ends that respectively form pivot structures for pivotally coupling the hold-down member to the side walls of the receiving housing. The receiving compartment of the receiving housing defines an insertion space. The hold-down member is operable to rotate, with the pivot structures as a rotation center, between an open position and a holding position.

The hold-down member is made of metal and the receiving housing is at least partly made of metal to form a conduction section, which is connected to at least one grounding terminal.

When the hold-down member is at the open position and a circuit flat cable is inserted into the insertion space of the receiving compartment, a depression and holding end of the hold-down member is operable to depress down and hold a surface of the circuit flat cable and set the hold-down member at the holding position, wherein the hold-down member is put in electrical connection with the grounding terminal through the conduction section.

In another embodiment of the present invention, an insertion end of a circuit adaptation board is insertable into the insertion space of the receiving compartment when the hold-down member is at the open position, and a depression and holding end of the hold-down member is operable to depress down and hold a surface of the circuit adaptation board and set the hold-down member at the holding position to thereby securely clamp the circuit adaptation board.

A circuit flat cable can be securely bonded to the circuit adaptation board to establish electrical connection therebetween. The circuit adaptation board may transfer electrical signals carried by the circuit flat cable through the first contact tips of the conductive terminal to a circuit board to suit the needs of various applications in the art.

With the technical solution adopted in the present invention, due to the fact that the hold-down member and the conduction sections of receiving housing are made of metallic materials, when an electrical connector and a circuit flat cable coupled thereto serve to transmit signals and/or power in an electrical/electronic system, external electromagnetic interference can be drained to a circuit board through grounding terminals of the connector so as to effectively overcome the deficiency of noises being caused in the transmission of signals between systems that degrade the quality of signals and thus providing excellent shielding result.

Further, since the circuit flat cable is clamped and retained by the hold-down member, compliance with ZIF connector arrangement is realized. This arrangement allows eliminating the potential mechanical damage occurring in an electronic assembly and the difficulty of assembling caused by excessive insertion force of the conventional connector used in integrated circuits, printed circuit boards, and/or flat cables or flexible printed circuits.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
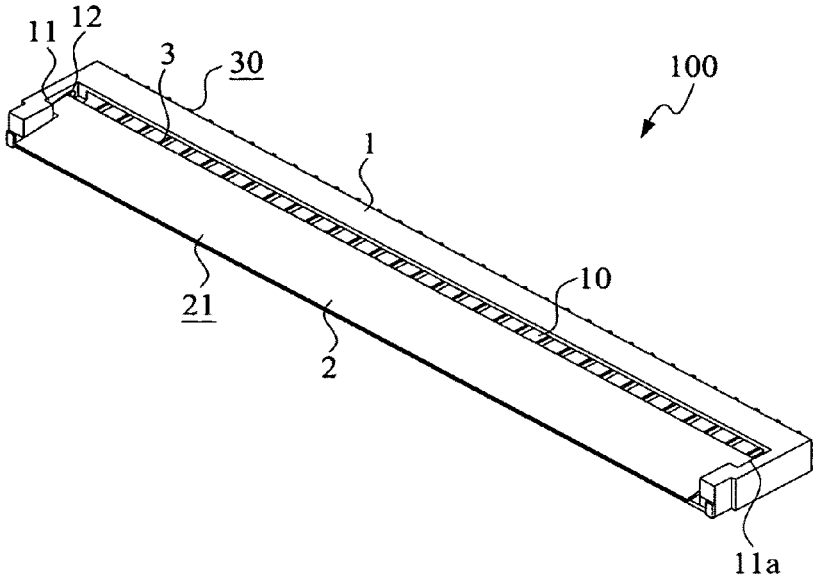
FIG. 1 is a perspective view of a first embodiment in accordance with the present invention.
Figure 2:
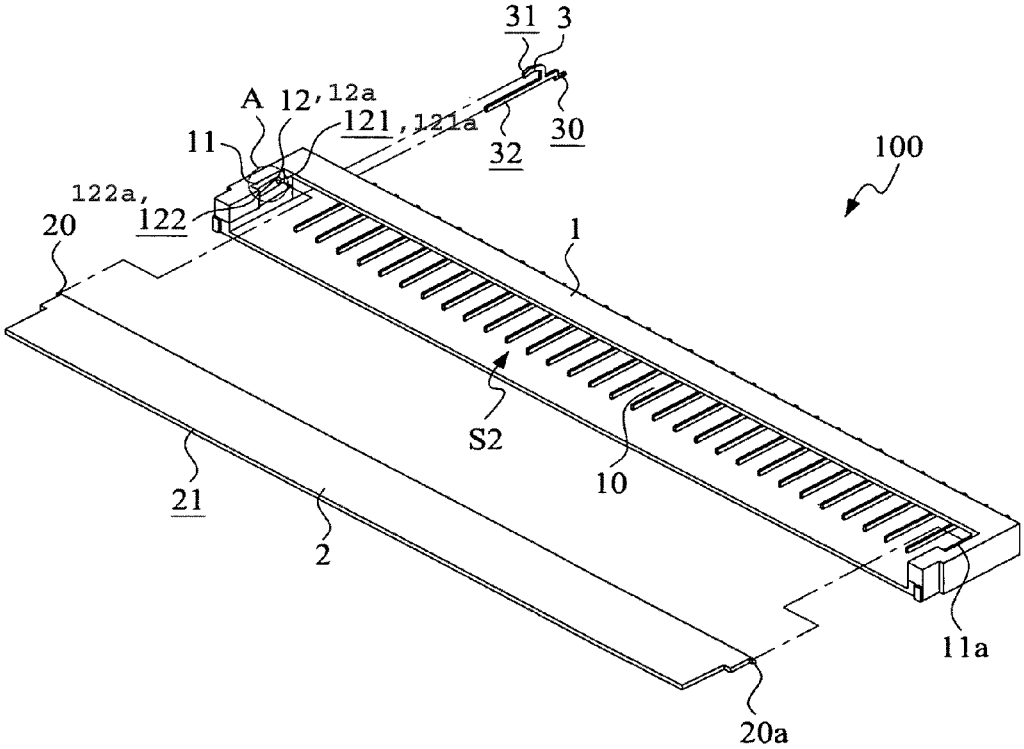
FIG. 2 is an exploded view of the first embodiment of the present invention.
Figure 3:
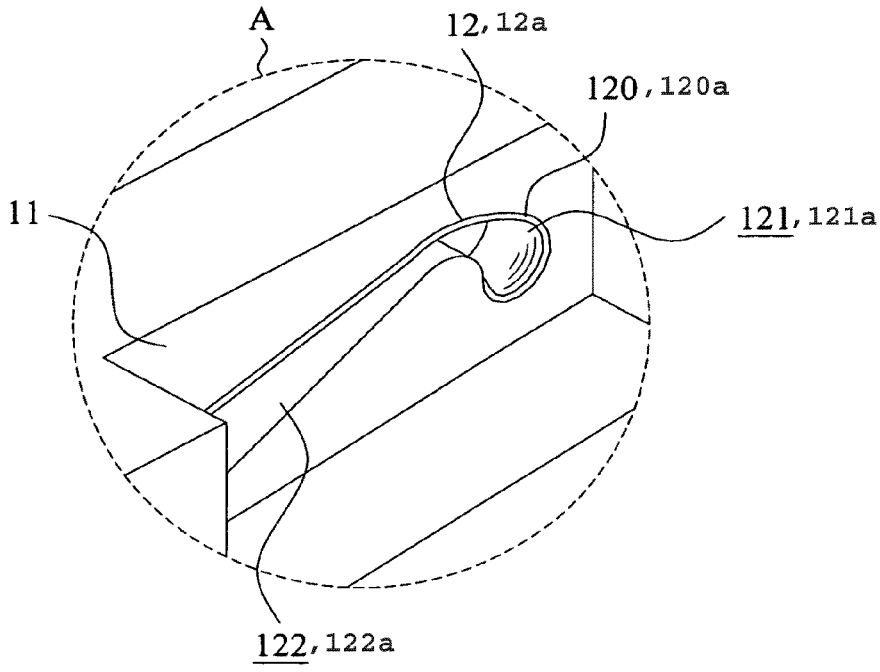
FIG. 3 is an enlarged view of a portion of the first embodiment of the present invention.
Figure 4:
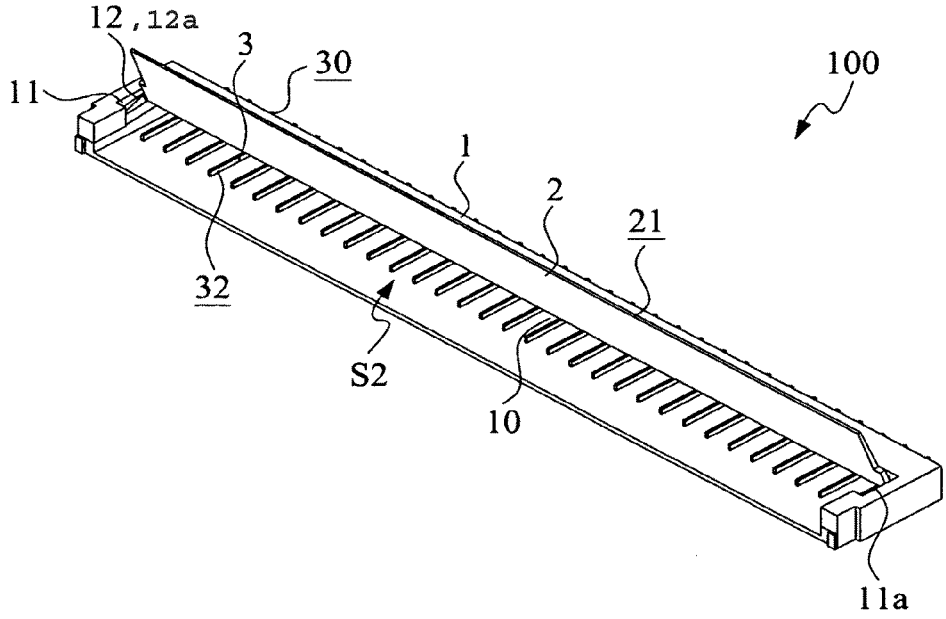
FIG. 4 is a perspective view of the first embodiment of the present invention illustrating a hold-down member set in an open position.

With reference to the drawings and in particular to FIG. 1, which shows a perspective view of a first embodiment in accordance with the present invention; FIG. 2, which shows an exploded view of the first embodiment of the present invention; FIG. 3, which shows an enlarged view of a portion of the first embodiment of the present invention; and FIG. 4, which shows a perspective view of the first embodiment of the present invention illustrating a hold-down member set in an open position, the present invention provides a shielded insertion and connection structure 100 for a flat cable connector. The shielded insertion and connection structure 100 comprises a receiving housing 1 and a hold-down member 2. The receiving housing 1 forms a receiving compartment 10 and two side walls 11, 11*a* formed at opposite ends of the receiving compartment 10.

The opposite side walls 11, 11*a* of the receiving housing 1 respectively form guide slots 12, 12*a*. Each of the guide slots 12, 12*a* is at least partly formed of a metallic material and forms a conduction section 120, 120*a*. Each of the guide slots 12, 12*a* has at least a first end 121, 121*a* and at least an opposite second end 122, 122*a*.

As shown, the hold-down member 2 of the present invention is made of metal. The hold-down member 2 has opposite ends that respectively form pivot structures 20, 20*a*.

In the present invention, the receiving compartment 10 of the receiving housing 1 defines an insertion space S2. The receiving compartment 10 has an inside wall through which a plurality of spaced conductive terminals 3 extends and is retained. Each conductive terminal 3 has an end serving as a first contact tip 30 for electrical engagement with a corresponding conductive contact 61 of a circuit board 6. The conductive terminal 3 has an end opposite to the first contact tip 30 and forming a second contact tip 31 and a third contact tip 32 for electrical engagement with a corresponding conductive contact 51 of a circuit flat cable 5.

Figure 5:
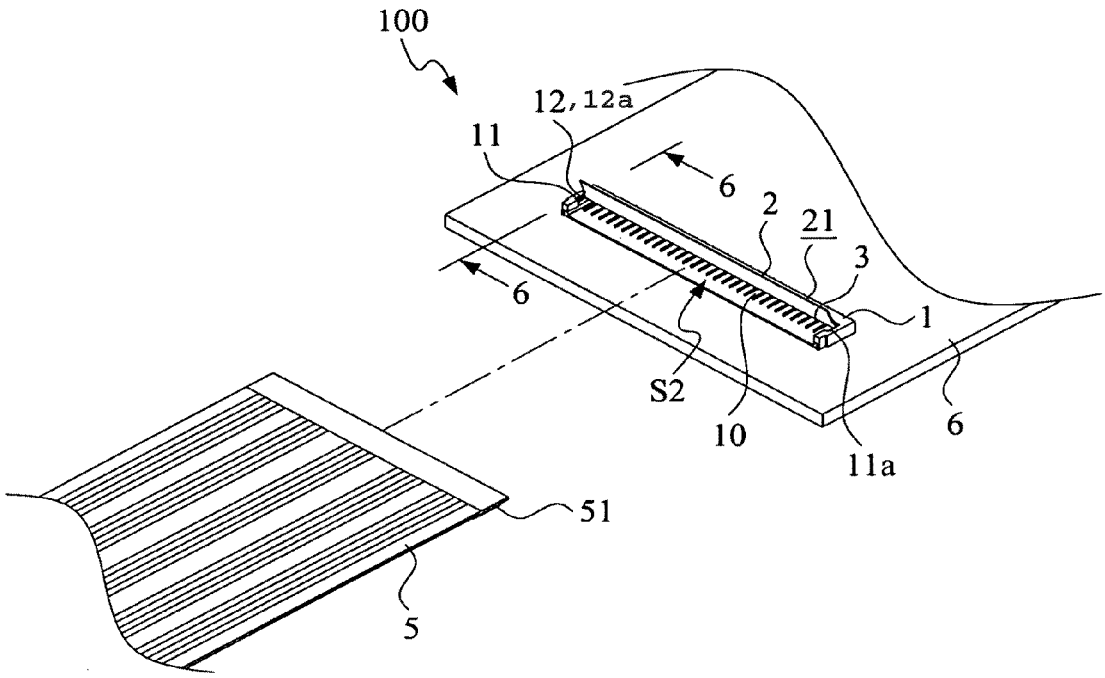
FIG. 5 is a perspective view illustrating the operation of the first embodiment of the present invention in a first phase.
Figure 6:
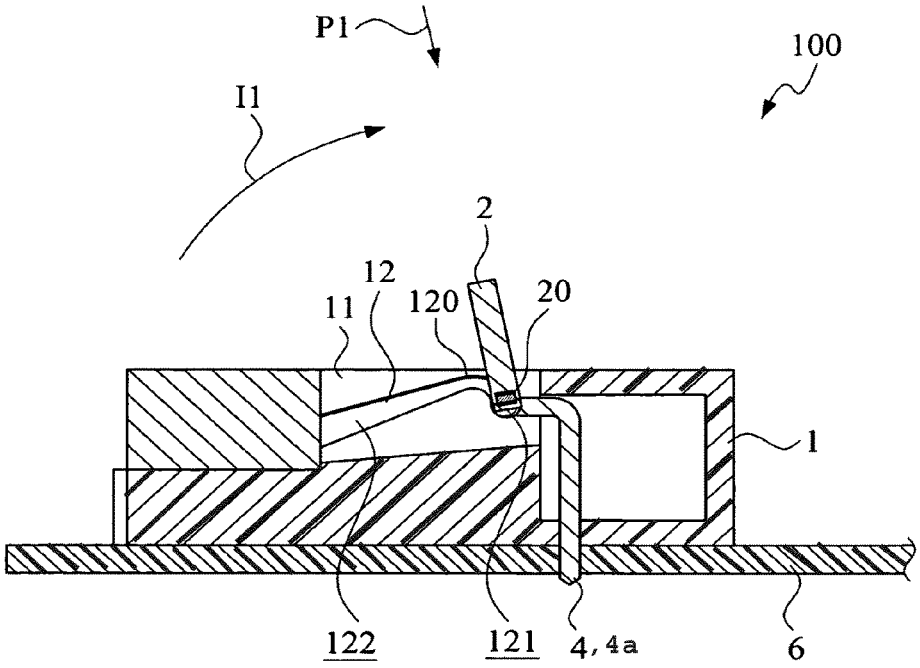
FIG. 6 is a cross-sectional view of the first embodiment of the present invention taken along line 6-6 of FIG. 5.

Referring to FIGS. 5 and 6, of which FIG. 5 is a perspective view illustrating the operation of the first embodiment of the present invention in a first phase and FIG. 6 is a cross-sectional view of the first embodiment of the present invention taken along line 6-6 of FIG. 5, the conduction sections 120, 120*a* of the guide slots 12, 12*a* of the receiving housing 1 of the present invention are each connected to at least one grounding terminal 4, 4*a*. The grounding terminals 4, 4*a* extend through and are retained on circuit board 6. As shown, in operation, the pivot structures 20, 20*a* of the hold-down member 2 are respectively positioned into and slide along the guide slots 12, 12*a* formed in the side walls 11, 11*a* of the receiving housing 1 and the pivot structures 20, 20*a* also define a rotation center about which the hold-down member 2 may rotate between an open position P1 and a holding position P2.

To insert a circuit flat cable 5 inserted into the insertion space S2 of the receiving compartment 10 of the 1, the hold-down member 2 is operated in such a way to have the pivot structures 20, 20*a* of the hold-down member 2 moving from the first ends 121, 121*a* of the guide slots 12, 12*a* to the second ends 122, 122*a* and at the same time, the pivot structures 20, 20*a* provide the rotation center about which the hold-down member 2 rotates in a rotation direction I1 toward the open position P1.

Figure 7:
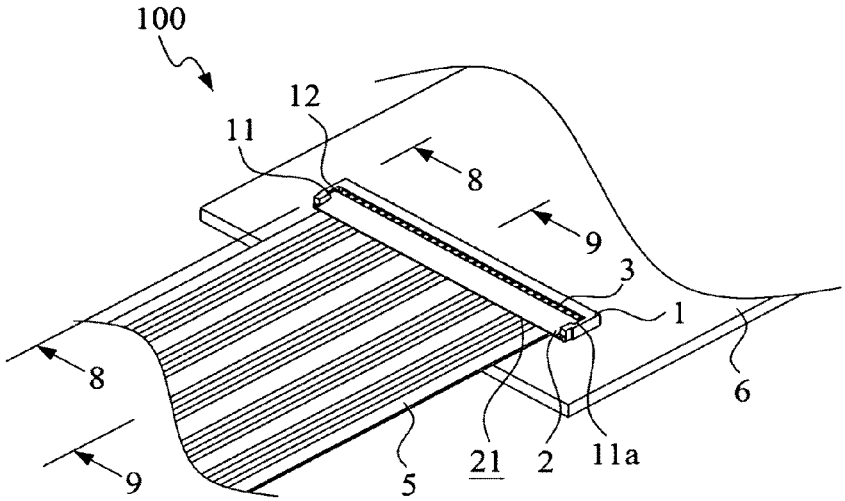
FIG. 7 is a perspective view illustrating the operation of the first embodiment of the present invention in a second phase.
Figure 8:
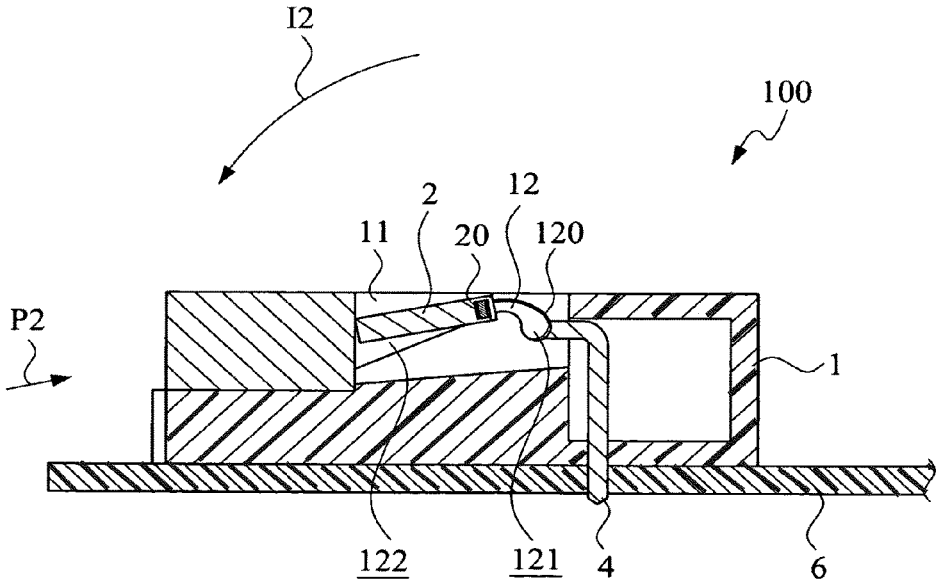
FIG. 8 is a cross-sectional view of the first embodiment of the present invention taken along line 8-8 of FIG. 7.
Figure 9:
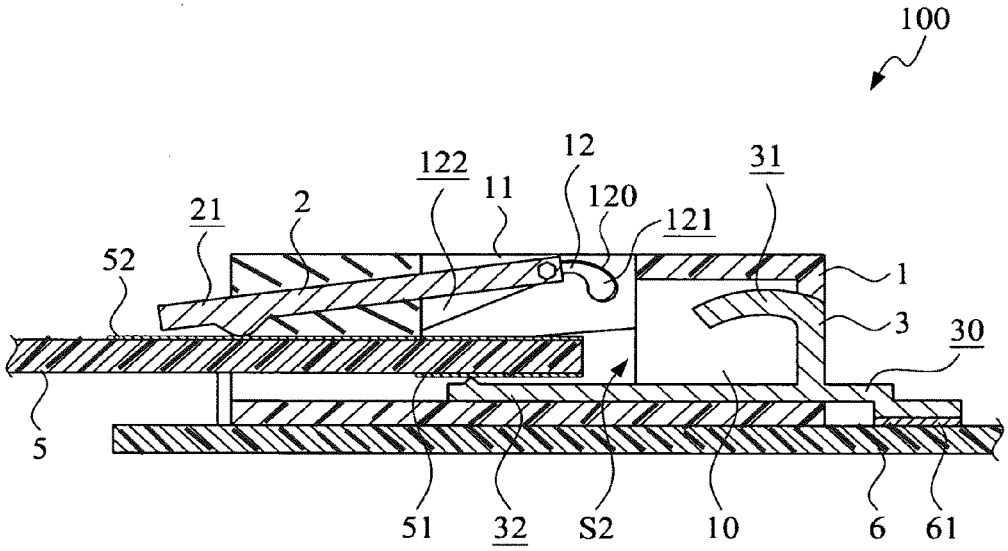
FIG. 9 is a cross-sectional view of the first embodiment of the present invention taken along line 9-9 of FIG. 7.

Referring to FIGS. 7-9, of which FIG. 7 is a perspective view illustrating the operation of the first embodiment of the present invention in a second phase, FIG. 8 is a cross-sectional view of the first embodiment of the present invention taken along line 8-8 of FIG. 7, and FIG. 9 is a cross-sectional view of the first embodiment of the present invention taken along line 9-9 of FIG. 7, when the circuit flat cable 5 has been inserted into the insertion space S2 of the receiving compartment 10 of the receiving housing 1, a depression and holding end 21 of the hold-down member 2 is operated to press down and thus hold a surface of the circuit flat cable 5. At the same time, the pivot structures 20, 20*a* of the hold-down member 2 move from the first ends 121, 121*a* of the guide slots 12, 12*a* to the second ends 122, 122*a* and, with the pivot structures 20, 20*a* as the rotation center, the hold-down member 2 is also rotated in a rotation direction I2 from the open position P1 to the holding position P2.

As shown in FIG. 8, the hold-down member 2 can be set in conductive engagement with the grounding terminals 4, 4*a* through the pivot structures 20, 20*a* thereof and the conduction sections 120, 120*a* of the guide slots 12, 12*a*. Since the hold-down member 2, the pivot structures 20, 20*a*, and the conduction sections 120, 120*a* are made of metals, the circuit flat cable 5 can conduct external electromagnetic interference through an end of the circuit flat cable 5 by means of the hold-down member 2, the pivot structures 20, 20*a*, the conduction sections 120, 120*a*, and the grounding terminals 4, 4*a* to the circuit board 6 to thereby realize excellent shielding result.

As shown in FIG. 9, when a circuit flat cable 5 is inserted into the shielded insertion and connection structure 100 of the present invention, the depression and holding end 21 of the hold-down member 2 is manipulated to press down onto a grounding zone 52 of the circuit flat cable 5, and the conductive contacts 51 of the circuit flat cable 5 are precisely located to engage the respective third contact tips 32 of the conductive terminals 3 to establish electrical connection therebetween to allow electrical signals to be transmitted from the first contact tips 30 of the conductive terminals 3 to the circuit board 6.

Figure 10:
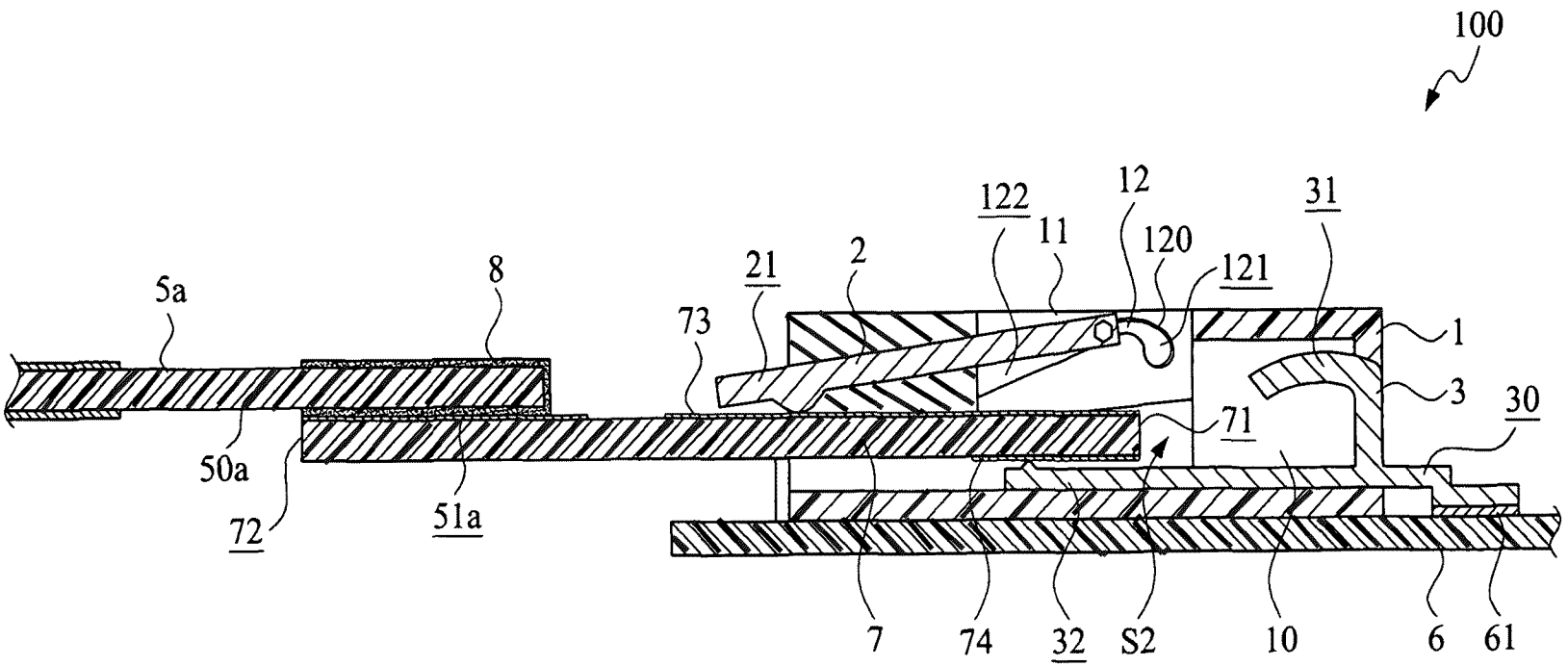
FIG. 10 is a cross-sectional view showing an application of the present invention where a circuit adaptation board is inserted into a connector in accordance with an embodiment of the present invention and a circuit flat cable is jointed to the circuit adaptation board.

Referring to FIG. 10, which is a cross-sectional view showing an application of the present invention where a circuit adaptation board is inserted into a connector in accordance with an embodiment of the present invention and a circuit flat cable is jointed to the circuit adaptation board, the shielded insertion and connection structure 100 of the instant embodiment has a structure composed of constituent components similar to the previous embodiment and the same or similar components will carry the same references for simplification and correspondence. A difference is provided between the instant embodiment and the previous one to suit the needs of practical applications, where an insertion end 71 of a circuit adaptation board 7 is insertable into the insertion space S2 of the receiving compartment 10 when the hold-down member 2 is at the open position P1 and, after the insertion, the depression and holding end 21 of the hold-down member 2 is depressible downward to press and hold a surface of the circuit adaptation board 7, by which the hold-down member 2 is set at the holding position P2 to securely clamp the circuit adaptation board 7.

As shown, the circuit adaptation board 7 comprises the insertion end 71, a flat cable connection end 72 that is opposite to the insertion end 71, a grounding zone 73, and a plurality of conductive contacts 74. The flat cable connection end 72 functions to allow conductive contacts 51*a* of a connection section 50*a* of a circuit flat cable 5*a* to be positioned thereon and coupled thereto. A cover film 8 may then be applied through soldering or coating to securely bond the circuit flat cable 5*a* to the circuit adaptation board 7. The grounding zone 73 is formed on the surface of the circuit adaptation board 7 to allow the depression and holding end 21 of the hold-down member 2 to firmly depress and hold the grounding zone 73. The plurality of conductive contacts 74 of the circuit adaptation board 7 are precisely located to respectively engage the third contact tips 32 of the conductive terminals to establish electrical connection therebetween thereby allowing electrical signals carried by the circuit flat cable 5*a* to be transmitted from the first contact tips 30 of the conductive terminals 3 to the circuit board 6.

Figure 11:
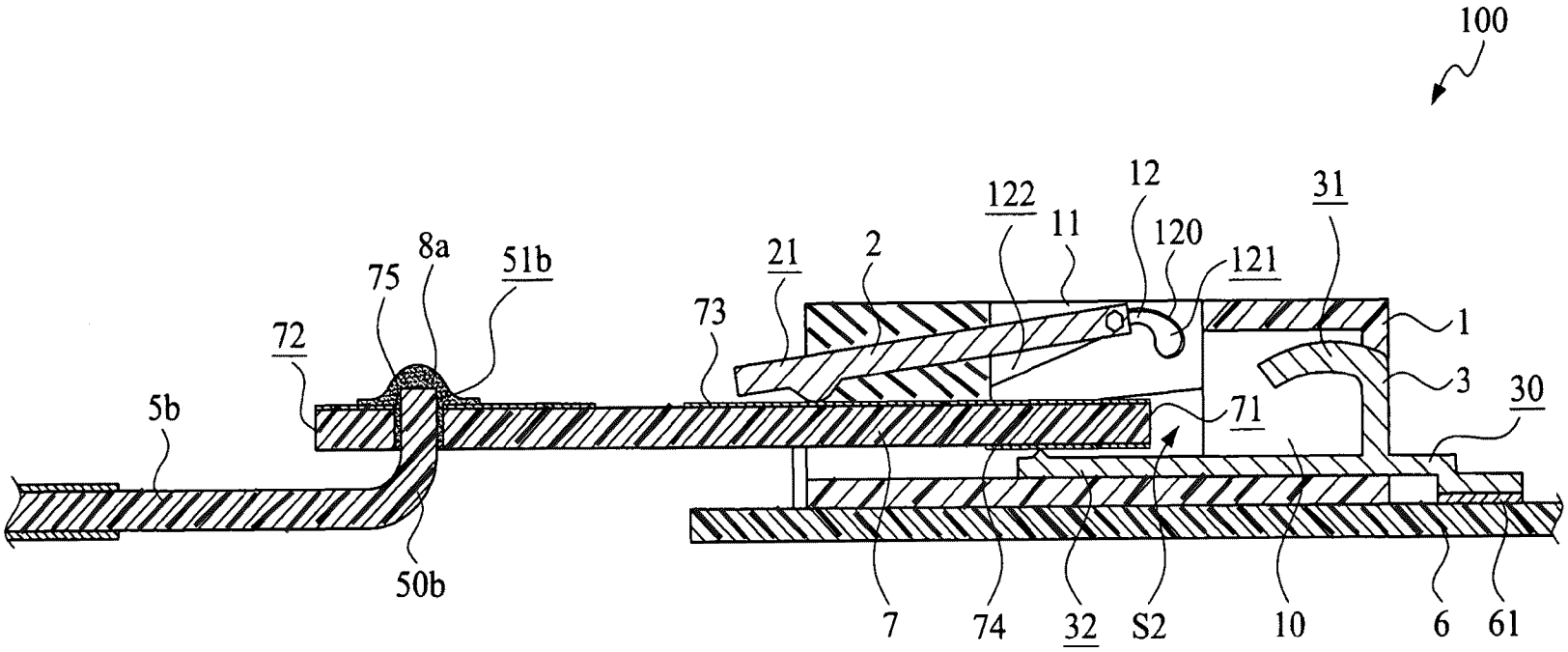
FIG. 11 is a cross-sectional view showing an application of the present invention where a circuit adaptation board is inserted into a connector in accordance with another embodiment of the present invention and a circuit flat cable is jointed to the circuit adaptation board.
Figure 12:
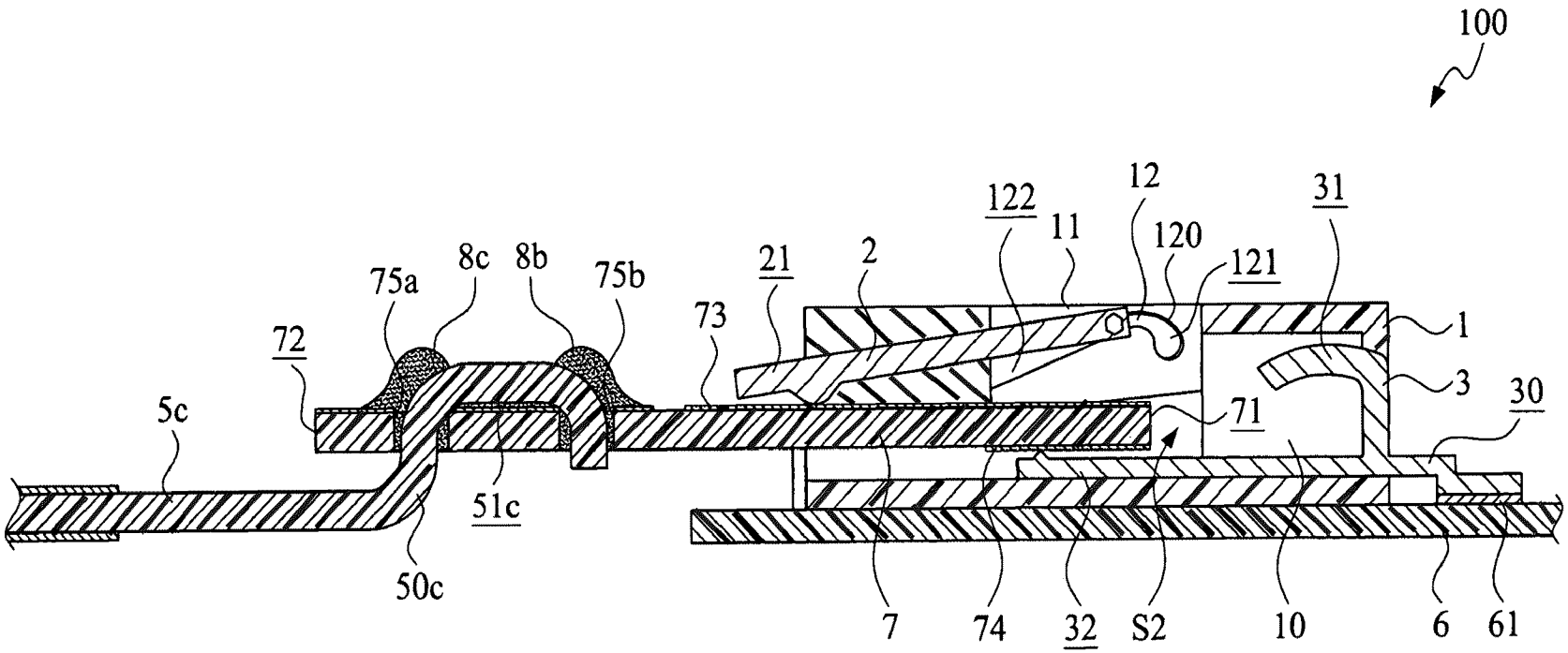
FIG. 12 is a cross-sectional view showing an application of the present invention where a circuit adaptation board is inserted into a connector in accordance with a further embodiment of the present invention and a circuit flat cable is jointed to the circuit adaptation board.

Referring to FIGS. 11 and 12, of which FIG. 11 is a cross-sectional view showing an application of the present invention where a circuit adaptation board is inserted into a connector in accordance with another embodiment of the present invention and a circuit flat cable is jointed to the circuit adaptation board and FIG. 12 is a cross-sectional view showing an application of the present invention where a circuit adaptation board is inserted into a connector in accordance with a further embodiment of the present invention and a circuit flat cable is jointed to the circuit adaptation board, both embodiments comprise constituent components similar to the previous embodiment and the same or similar components will carry the same references for simplification and correspondence. A difference residing in the embodiment illustrated in FIG. 11 is that a circuit adaptation board 7 forms a through hole 75 at a location close to the flat cable connection end 72 to receive the extension of a connection section 50*b* of a circuit flat cable 5*b* for positioning conductive contact 50*b* of the circuit flat cable 5*b* to engage the flat cable connection end 72 of the circuit adaptation board 7 and solders 8*a* are applied to securely bond the circuit flat cable 5*b* to the circuit adaptation board 7. As shown in the drawing, the circuit flat cable 5*b* is inserted into the circuit adaptation board 7 in a forward direction, and however, it is apparent that the circuit flat cable 5*b* can be inserted in an opposite direction and then bonded to the circuit adaptation board 7. The arrangement shown in the drawings is not to be construed as limitation to the scope and application of the present invention.

In the embodiment illustrated in FIG. 12, a circuit adaptation board 7 forms two through holes 75*a*, 75*b* in two locations close to a flat cable connection end 72 thereof to provide the same function of receiving the sequential extension of a connection section 50*c* of a circuit flat cable 5*c* through the through hole 75*a* and the through hole 75*b* so as to position conductive contacts 51*c* of the circuit flat cable 5*c* for engagement with the flat cable connection end 72 of the circuit adaptation board 7. Solders 8*b*, 8*c* are then applied to securely bond the circuit flat cable 5*c* to the circuit adaptation board 7 to form the arrangements as shown in FIGS. 11 and 12, in which the circuit flat cable 5*c* is inserted into the circuit adaptation board 7 in a forward direction. However, it is apparent that the circuit flat cable 5*c* can be inserted in an opposite direction and then bonded to the circuit adaptation board 7.

It is apparent that besides soldering to bond the circuit flat cable to the circuit adaptation board, other means that are known to those having ordinary skills in the art may be applied, such as using conductive adhesives to adhesively attaching the circuit flat cable to the circuit adaptation board, or employing direct physical engagement, for example using a depressing and holding tape to depress and hold the circuit flat cable in position on the circuit adaptation board, or providing contacts or metallic spring plates on the circuit adaptation board to receive the insertion of the circuit flat cable or the resiliently retaining the circuit flat cable. Thus, what is shown in the drawings is only illustrative examples and is not to be construed as limitation to the scope of the present invention.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A shielded insertion and connection structure of a flat cable connector, comprising a receiving housing and a hold-down member, the receiving housing forming a receiving compartment and two side walls formed at opposite ends of the receiving compartment, each of the side walls having a guide slot formed therein, a plurality of conductive terminals being received in the receiving compartment, the hold-down member having opposite ends that respectively form pivot structures that are respectively and slidably received in the guide slots in the side walls for pivotally coupling the hold-down member thereto, the receiving compartment of the receiving housing defining an insertion space, the hold-down member being operable to rotate with the pivot structures as a rotation center between an open position and a holding position and whereby when the hold-down member is operated, the pivot structures are allowed to slide along the guide slots of the receiving housing and also serve as to define the rotation center about which the hold-down member is rotatable between the open position and the holding position, a conduction section being formed by the hold-down member being made of metal and the receiving housing being at least partly made of metal with the guide slots being at least partly formed of metal, the conduction section being connected to at least one grounding terminal, whereby when the hold-down member is at the open position, an insertion end of a circuit adaptation board being insertable into the insertion space of the receiving compartment, the circuit adaptation board having a flat cable connection end opposite to the insertion end functioning to couple a circuit flat cable thereto, a cover film being applied through soldering or coating to securely bond the circuit flat cable to the circuit adaptation board, and the hold-down member has a depression and holding end that is operable to depress down and hold a surface of the circuit adaptation board and set the hold-down member at the holding position, wherein the hold-down member is put in electrical connection with the grounding terminal through the conduction section.

2. The shielded insertion and connection structure as claimed in claim 1, wherein the guide slots formed in the side walls of the receiving housing respectively comprise at least a first end and at least an opposite second end, the pivot structures of the hold-down member being respectively movable between the first ends and the second ends of the guide slots to selectively set the hold-down member at the open position and the holding position.

3. The shielded insertion and connection structure as claimed in claim 1, wherein each of the conductive terminals has an end serving as a first contact tip for electrical engagement with a corresponding conductive contact of a circuit board.

4. The shielded insertion and connection structure as claimed in claim 3, wherein each of the conductive terminals has an end opposite to the first contact tip and forming a second contact tip and a third contact tip for electrical engagement with a corresponding conductive contact of the circuit flat cable.

5. A shielded insertion and connection structure of a flat cable connector, comprising a receiving housing and a hold-down member, the receiving housing forming a receiving compartment and two side walls formed at opposite ends of the receiving compartment, each of the side walls having a guide slot formed therein, a plurality of conductive terminals being received in the receiving compartment, the hold-down member having opposite ends that respectively form pivot structures that are respectively and slidably received in the guide slots in the side walls for pivotally coupling the hold-down member thereto, the receiving compartment of the receiving housing defining an insertion space, the hold-down member being operable to rotate with the pivot structures as a rotation center between an open position and a holding position and whereby when the hold-down member is operated, the pivot structures are allowed to slide along the guide slots of the receiving housing and also serve as to define the rotation center about which the hold-down member is rotatable between the open position and the holding position, a conduction section being formed by the hold-down member being made of metal and the receiving housing being at least partly made of metal with the guide slots being at least partly formed of metal, the conduction section being connected to at least one grounding terminal, whereby when the hold-down member is at the open position, an insertion end of a circuit adaptation board is insertable into the insertion space of the receiving compartment, and the hold-down member has a depression and holding end that is operable to depress down and hold a surface of the circuit adaptation board and set the hold-down member at the holding position, wherein the hold-down member is put in electrical connection with the grounding terminal through the conduction section, the surface of the circuit adaptation board forms at least one grounding zone whereby when the depression and holding end of the hold-down member is operated to depress down and hold the surface of the circuit adaptation board, the depression and holding end of the hold-down member is put in engagement with the grounding zone, the circuit adaptation board having a flat cable connection end that is opposite to the insertion end and functions to couple to the flat cable.

6. The shielded insertion and connection structure as claimed in claim 5, wherein the guide slots formed in the side walls of the receiving housing respectively comprise at least a first end and at least an opposite second end, the pivot structures of the hold-down member being respectively movable between the first ends and the second ends of the guide slots to selectively set the hold-down member at the open position and the holding position.

7. The shielded insertion and connection structure as claimed in claim 5, wherein each of the conductive terminals has an end serving as a first contact tip for electrical engagement with a corresponding conductive contact of a circuit board.

8. The shielded insertion and connection structure as claimed in claim 7, wherein each of the conductive terminals has an end opposite to the first contact tip and forming a second contact tip and a third contact tip for electrical engagement with a corresponding conductive contact of the circuit adaptation board.

* * * * *